US008747128B2

(12) United States Patent
Rodriguez

(10) Patent No.: US 8,747,128 B2
(45) Date of Patent: Jun. 10, 2014

(54) LOCKING DEVICE FOR ELECTRICAL SOCKET

(75) Inventor: Jean-Michel Rodriguez, Montpellier (FR)

(73) Assignee: International Business Machines Corporation, Armonk, NY (US)

( * ) Notice: Subject to any disclaimer, the term of this patent is extended or adjusted under 35 U.S.C. 154(b) by 116 days.

(21) Appl. No.: 13/471,580

(22) Filed: May 15, 2012

(65) Prior Publication Data

US 2013/0029504 A1 Jan. 31, 2013

(30) Foreign Application Priority Data

Jul. 26, 2011 (EP) ..... 11290342

(51) Int. Cl.
*H01R 13/44* (2006.01)

(52) U.S. Cl.
USPC ..... 439/133

(58) Field of Classification Search
USPC ..... 439/133, 304, 148, 347
See application file for complete search history.

(56) References Cited

U.S. PATENT DOCUMENTS

| | | | | | |
|---|---|---|---|---|---|
| 4,964,284 | A | * | 10/1990 | McDaid | 70/14 |
| 5,055,057 | A | * | 10/1991 | Boyer | 439/134 |
| 5,169,326 | A | | 12/1992 | Werner | |
| 5,171,155 | A | | 12/1992 | Mendoza | |
| 5,340,324 | A | * | 8/1994 | Fields et al. | 439/133 |
| 5,507,656 | A | | 4/1996 | Ales | |
| 6,142,797 | A | | 11/2000 | Bailey | |
| 6,508,654 | B1 | | 1/2003 | Tatz | |
| 6,773,277 | B2 | | 8/2004 | Issa | |
| 6,935,871 | B2 | | 8/2005 | Maurer, Jr. | |
| 6,968,678 | B2 | * | 11/2005 | Le Leux et al. | 60/280 |
| 6,979,220 | B1 | | 12/2005 | Ray et al. | |
| 7,497,705 | B2 | | 3/2009 | Larson et al. | |
| 7,806,706 | B2 | | 10/2010 | Obenshain | |

* cited by examiner

*Primary Examiner* — Phuong Dinh
(74) *Attorney, Agent, or Firm* — Andrea Bauer; Hoffman Warnick LLC

(57) ABSTRACT

A locking device is provided for an electrical socket. The locking device includes a device body having a projecting member projecting from the device body, wherein the projecting member is adapted for engagement with an aperture provided in an electrical socket. The projecting member has first and second positions. In a first position the projecting member is adapted for engagement with the aperture and the locking device can be connected and disconnected from the socket. In a second position, the projecting member cannot disengage from the aperture and the projecting member is lockable in the second position. The electrical socket may be a power cable receiver on an electrical appliance, or a power supply socket.

20 Claims, 4 Drawing Sheets

LOCKING DEVICE FOR ELECTRICAL SOCKET

TECHNICAL FIELD

This invention relates to the field of locking devices for electrical sockets. In particular, the invention relates to a locking device for preventing an electrical appliance from being powered.

RELATED ART

It is often desired to prevent an electrical appliance from being powered on by an unauthorized person. For example, the electrical appliance may be dangerous if operated by an unqualified operator, or may simply need monitoring such as an office or school resource. Electrical appliances which are left plugged in may be on stand-by and using electricity even though they are not in operation.

Many prior art solutions have been proposed in which a locking device is provided for the power plug at the end of a cable to prevent the plug from being inserted into an electrical supply, such as a wall socket. Such systems are not useful when a removable power cable is attached to the appliance. Also, a cable may be cut to remove the locked plug, and a new plug wired onto the cable.

SUMMARY

According to a first aspect of the present invention there is provided a locking device for an electrical socket, comprising: a device body having a projecting member projecting from the device body, wherein the projecting member is adapted for engagement with an aperture provided in an electrical socket; the projecting member having first and second positions, wherein: in a first position the projecting member is adapted for engagement with the aperture and the locking device can be connected and disconnected from the socket; and in a second position, the projecting member cannot disengage from the aperture and the projecting member is lockable in the second position.

The projecting member may be adapted to be rotated between the first and second positions or may be slidable between the first and second positions.

In one embodiment, the projecting member is a T-shaped member and corresponds to an elongate aperture provided in an electrical socket, wherein in the first position the T-shaped member fits in the elongate aperture, and in the second position the T-shaped member is rotated and cannot be withdrawn through the elongate aperture.

The locking device may include apertures in the device body to receive male connectors of the electrical socket. Alternatively, the locking device may include male dummy connectors on the device body for insertion in apertures of the electrical socket.

The projecting member may be provided adjacent the apertures in the device body or adjacent the male dummy connectors on the device body.

If the electrical socket has an outer housing, the device body may fit within the outer housing.

The locking device may be used at a power receiver socket of an appliance, at a power supplying socket, or may be incorporated into a plug for location in the electrical socket.

According to a second aspect of the present invention, there is provided an electrical socket having a locking device, comprising: an aperture in the electrical socket adapted to receive a projecting member of a locking device, the projecting member having first and second positions, wherein: in a first position the projecting member is adapted for engagement with the aperture and the locking device can be connected and disconnected from the socket; and in a second position, the projecting member cannot disengage from the aperture and the projecting member is lockable in the second position.

BRIEF DESCRIPTION OF THE DRAWINGS

The subject matter regarded as the invention is particularly pointed out and distinctly claimed in the concluding portion of the specification. The invention, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numbers may be repeated among the figures to indicate corresponding or analogous features.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

A locking device and a corresponding electrical power receiver at an appliance are described to prevent a power cable from being attached to the appliance by unauthorized users of the appliance.

Figure 1A:
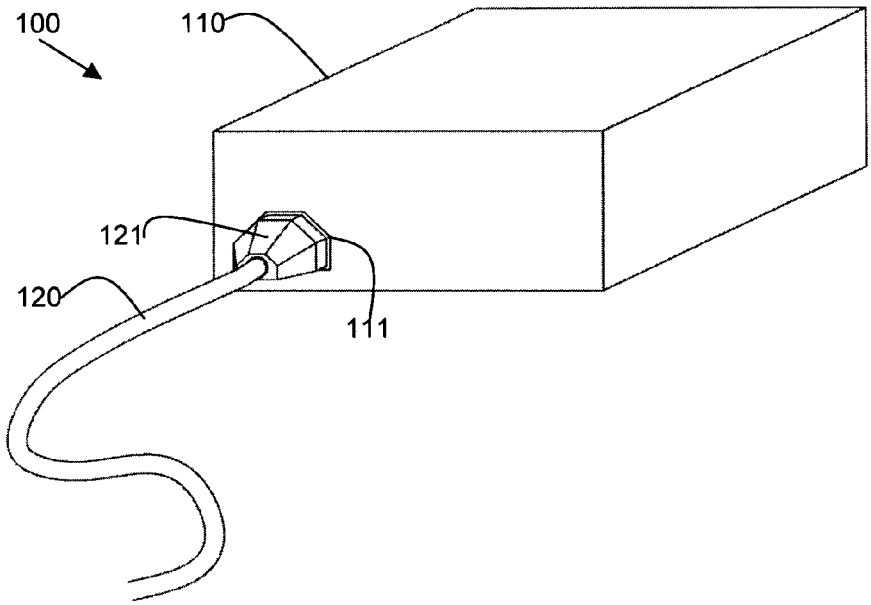
FIG. 1A (PRIOR ART)
FIG. 1A is a perspective view of an electrical appliance with a detachable electric power cable as known in the prior art.

Referring to FIG. 1A, a known apparatus 100 is shown including an electrical appliance 110 with a power cable 120 for connection to a power supply. The power cable 120 is removable from the electrical appliance 110 and has a connector 121 removably attachable to an electrical power receiver 111 at the electrical appliance 110. The connector 121 has at least one aperture or female connector (not shown). The power cable 120 may have a plug (not shown) at the opposite end of the cable from the appliance connector 121. The plug has at least one male connector for insertion into a power socket (not shown) such as a wall socket.

Figure 1B:
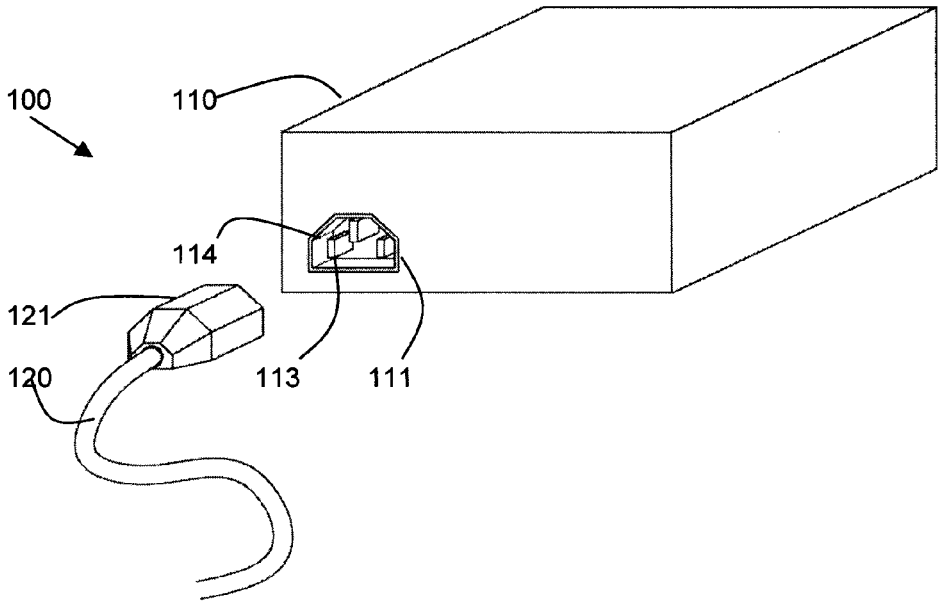
FIG. 1B (PRIOR ART)
FIG. 1B is a perspective view of the electrical appliance of FIG. 1A without an electric power cable as known in the prior art.

FIG. 1B shows the known electrical appliance 110 with the power cable 120 removed. The electrical appliance 110 may be any form of electrically powered equipment with an electrical power receiver 111. The electrical power receiver 111 is in the form of a socket built into the electrical appliance 110. The socket may have at least one male connector 113 (usually two or three male connectors 113) within a socket housing 114. The at least one male connector 113 of the socket is insertable into the corresponding aperture(s) of the power cable 120 connector 121.

Conventionally, electricity receiving components have male connectors, and electricity supplying components have female connectors. This is so that electricity supplying components are not exposed. Therefore, an electrical power receiver 111 at an appliance will have at least one male connector 113. Usually, there are either two male connectors of the same length, or three male connectors in a triangular arrangement. In the triangular arrangement, one connector is slightly longer which is the earth connector, which makes contact before the two conducting connectors.

Figure 2A:
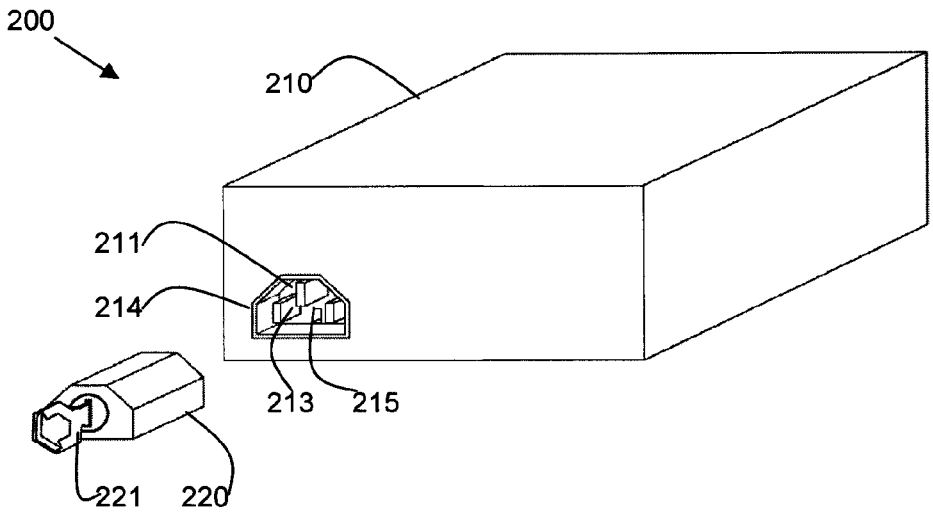
FIG. 2A is a perspective view of an electrical appliance with a locking device about to be inserted in accordance with the present invention.
Figure 2B:
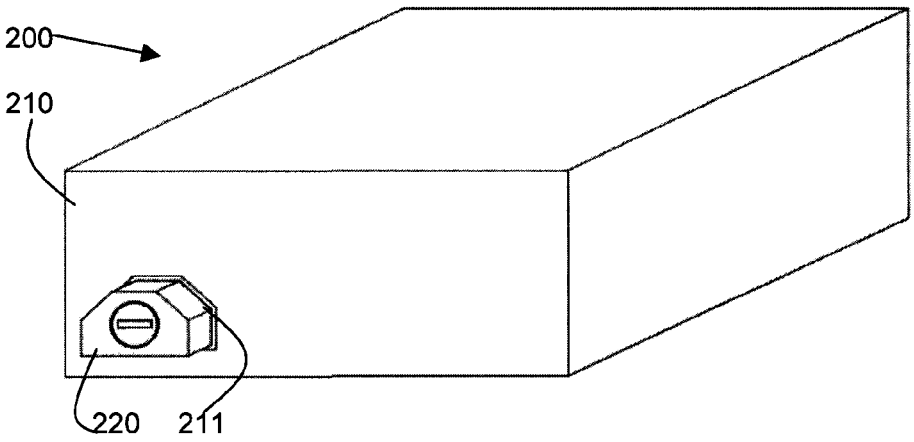
FIG. 2B is a perspective view of the electrical appliance of FIG. 2A with the locking device inserted.

Referring to FIGS. 2A and 2B, an apparatus 200 is shown which is an example embodiment of the present invention.

Referring to FIG. 2A, the apparatus 200 includes an electrical appliance 210 with an electrical power receiver 211 of the form described in relation to FIG. 1B, which is modified to include an aperture 215 within the socket housing 214 adjacent or between the at least one male connector 213. The aperture 215 provides a receiver for a locking mechanism as described further below. The aperture 215 may widen within the socket 212 to allow for rotation or sliding of a locking mechanism inserted into the aperture 215. More than one aperture 215 may be provided.

The apparatus 200 includes a locking device 220 for attachment to the electrical power receiver 211 of the electrical appliance 210 in place of the connector 121 of a power cable 120 (shown in FIGS. 1A and 1B). The locking mechanism of the locking device 220 may be operated by a key 221, combination lock, or other securing means.

FIG. 2B shows the locking device 220 attached to the electrical appliance 210. The locking device 220 may be of a suitable size and shape to fit within a socket housing 214. The locking device 220 includes a locking mechanism (described further below) which cooperates with the aperture 215 of the electrical power receiver 211 to lock the locking device 220 to the electrical appliance 210. FIG. 2B shows the locking device 220 in a locked position in the electrical power receiver 211 of the electrical appliance 210 with the key 221 removed. In this arrangement, the electrical appliance 210 cannot have a power cable 120 connected to it and so cannot be powered and operated.

Figure 3:
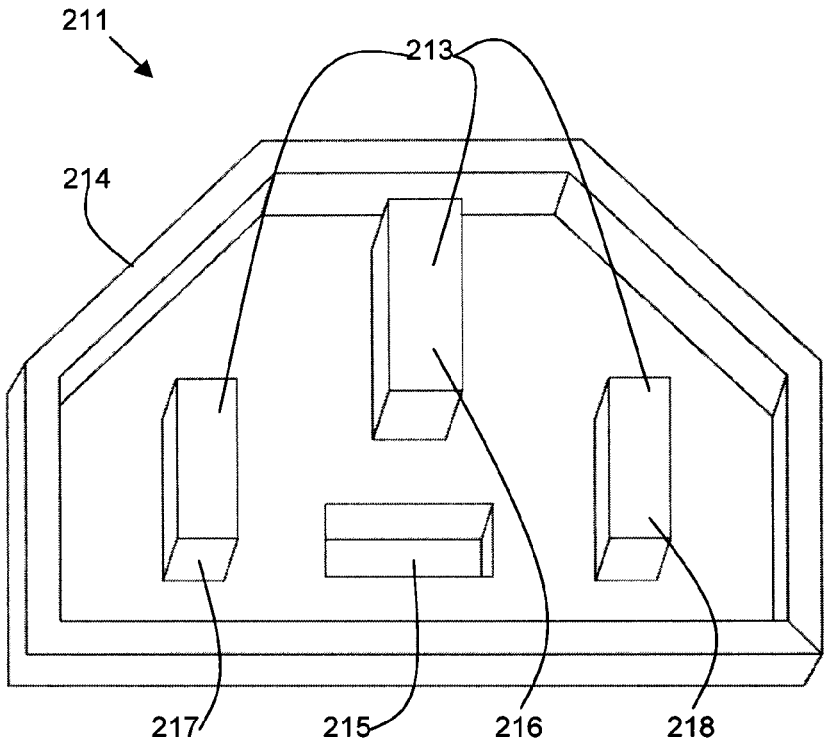
FIG. 3 is a perspective view of an electrical power receiver at an appliance in accordance with an aspect of the present invention.

Referring to FIG. 3, the electrical power receiver 211 is shown in more detail. An example embodiment of an electrical power receiver 211 having three male connectors 213 is shown. The electrical power receiver 211 has a socket housing 214 of a squared-hexagon shape as is well known in the art for power receivers.

Other examples may include socket housings of a rectangular form or figure of eight form for two pinned receivers. The shape of the electrical power receiver 211 is not relevant to the present invention, and a locking device 220 of any cross-sectional shape may be provided to suit electrical power receivers 211 of appliances.

The example embodiment of FIG. 3 has three male connectors 213 each of rectangular cross-section arranged in a parallel configuration with the middle connector 216 moved out of line with the other two connectors 217, 218 to provide a triangular arrangement. The middle connector 216 may be slightly longer and may be the earth connector.

An aperture 215 may be provided adjacent or between the male connectors 213. In this example, a rectangular aperture 215 is provided adjacent the middle connector 216, between the two other connectors 217, 218. Other forms of position and shape of the aperture 215 may be provided.

Figure 4A:
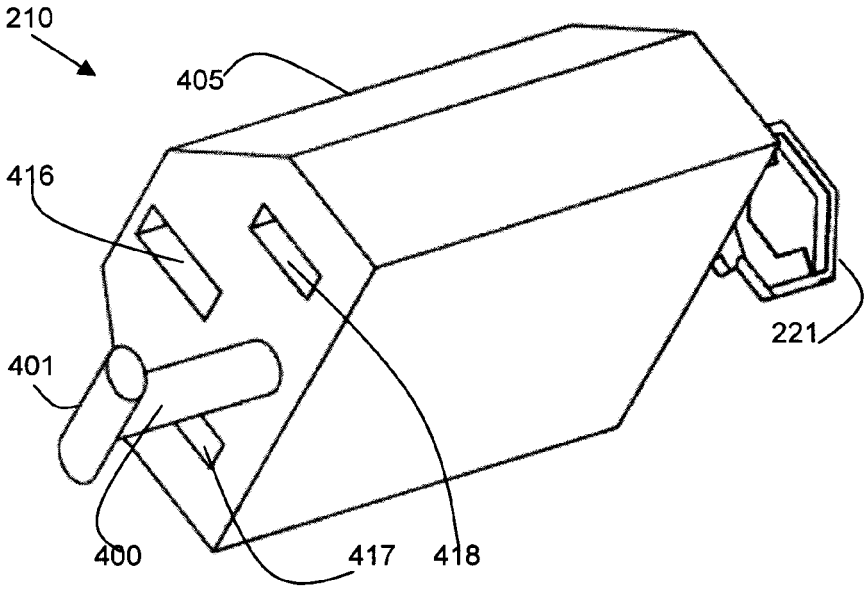
FIG. 4A is a first perspective view of a locking device for an electrical appliance in accordance with an aspect of the present invention.
Figure 4B:
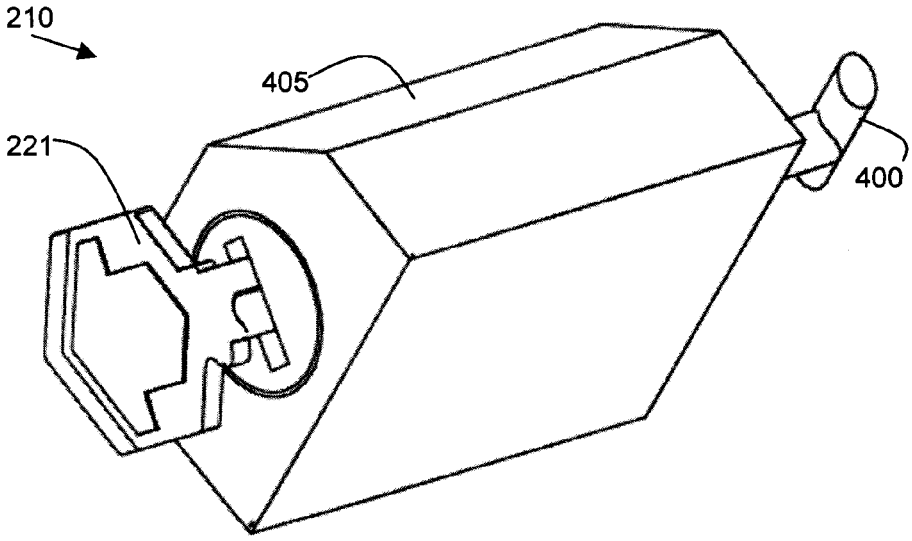
FIG. 4B is a second perspective view of the locking device of FIG. 4A.

Referring to FIGS. 4A and 4B, the example embodiment of the locking device 210 is shown in more detail. The locking device 210 may have a device body 405 of an elongate form with a cross-section which may correspond to a socket housing 214 of an electrical power receiver 211 of an appliance. In the example shown, the cross-section is a squared-hexagon corresponding to the electrical power receiver 211 of FIGS. 3A and 3B.

The locking device 210 includes apertures 416, 417, 418 corresponding to the male connectors 216, 217, 218, respectively, of the electrical power receiver 211. In this example, three apertures 416, 417, 418 are provided of rectangular form in an arrangement corresponding to the arrangement of the male connectors 216, 217, 218 of the electrical power receiver 211. The apertures may be any shape or arrangement to suit an electrical power receiver of an appliance.

The locking device 210 includes a locking mechanism with a projecting member 400 which projects from the device body 405 adjacent or between the apertures 416, 417, 418. The projecting member 400 corresponds in position relative to the apertures 416, 417, 418 to the position of the aperture 215 of the electrical power receiver 211 relative to the male connectors 216, 217, 218. In use, the projecting member 400 of the locking device 210 is insertable in the aperture 215 of the electrical power receiver 211.

The projecting member 400 is operated by a locking mechanism within the locking device 210 by a key 221 or other operating device such as a lever or knob with a combination lock.

In this example embodiment, the projecting member 400 is a T-shaped component which is rotatable between a first and second position, and lockable in the second position. In the first position, the projecting member 400 is insertable in the aperture 215 of the electrical power receiver 211 whilst the male connectors 216, 217, 218 of the electrical power receiver 211 are inserted into the apertures 416, 417, 418 of the locking device 210. In the second position, the projecting member 400 has been rotated, and due to the rectangular cross-section of the top 401 of the T-shaped component and the corresponding rectangular form of the aperture 215, the projecting member 400 cannot be removed from the aperture 215 and therefore, the locking device 210 cannot be removed from the electrical power receiver 211 of the appliance.

In this example embodiment, a rotatable T-shaped projecting member 400 is shown. However, other forms of rotating, sliding, or otherwise engaging members may be used.

The key 221 may be used to rotate the projecting member 400 and may be removed from the locking device 210 when the projecting member 400 is in the second locking position. Alternatively, other forms of operating devices may be used such as a lever with a combination lock which is operable to lock the projecting member 400 in the second position.

The key 221 may be at the opposite end of the device body 405 to the projecting member 400 and apertures 416, 417, 418 in order to provide easy access to the key socket 411 when the locking device 210 is attached to the appliance.

To remove a locking device 210 from an electrical appliance, the key 221 must be turned, or other form of operating device de-activated. This will move the projecting member 400 to the first position in which it can disengage from the aperture 215 of the electrical power receiver 211 and the locking device 210 can be removed from the electrical power receiver 211 allowing a power cable to be connected and the electrical appliance switched on.

Different forms of locking device 210 may be provided for different models of electrical power receivers of electrical apparatus.

In another aspect of the present invention, the locking device may be provided for preventing access to a power supply socket, such as a wall socket. This may be required to prevent unauthorized use of the power supply socket. The locking device may be of the form as described above, with the difference that it may have dummy male connectors for insertion into the apertures of the power supply socket. The power supply socket may have an additional aperture for receiving the projecting member of the locking device in addition to the receiving apertures for the plug's male connectors. In the cases where power supply sockets do not have surrounding housings, the locking device may be of any cross-sectional shape.

In a further aspect of the present invention, the locking device may be incorporated into an electrical plug for insertion into a power supply socket in order to lock the plug in the socket. This may be required to prevent an appliance from being disconnected from the power source. The power supply socket may have an additional aperture for receiving a projecting member which is added to the electrical plug, for example, adjacent or between the male connectors of the plug.

Improvements and modifications can be made to the foregoing without departing from the scope of the present invention.

The invention claimed is:

1. A locking device for a male electrical socket, the male electrical socket including a plurality of male connectors and an aperture, comprising:

a device body for electrically isolating the male electrical socket, including:

a projecting member projecting from the device body for engagement with the aperture of the male electrical socket when the device body is inserted into the male electrical socket; and a plurality of openings for receiving the plurality of male connectors of the male electrical socket when the device body is inserted into the male electrical socket;

the projecting member having first and second positions, wherein:

in the first position the projecting member is movable within the aperture and the locking device can be connected and disconnected from the male electrical socket; and in the second position, the projecting member is locked within the aperture and the device body is locked within the male electrical socket, wherein, when the projecting member is locked within the male electrical socket, the device body prevents a power cord from being connected to the male electrical socket.

2. The locking device as claimed in claim 1, wherein the projecting member is adapted to be rotated between the first and second positions.

3. The locking device as claimed in claim 1, wherein the projecting member is adapted to be slidable between the first and second positions.

4. The locking device as claimed in claim 2, wherein the aperture comprises an elongate aperture, and wherein the projecting member is a T-shaped member that corresponds to the elongate aperture provided in the male electrical socket, wherein in the first position the T-shaped member fits in the elongate aperture, and in the second position the T-shaped member is rotated and cannot be withdrawn through the elongate aperture.

5. The locking device as claimed in claim 1, wherein the projecting member is provided adjacent the openings in the device body.

6. The locking device as claimed in claim 1, wherein the male electrical socket has an outer housing and the device body fits within the outer housing.

7. The locking device as claimed in claim 1, wherein the locking device is for a power receiver socket of an appliance.

8. The locking device as claimed in claim 1, wherein the locking device is for a power supplying socket.

9. An electrical socket having a locking device for electrically isolating the electrical socket, comprising:

an aperture in the electrical socket adapted to receive a projecting member of a locking device, the projecting member having first and second positions, wherein:

in the first position the projecting member engages with the aperture and the locking device can be connected and disconnected from the electrical socket; and in the second position, the projecting member cannot disengage from the aperture, the projecting member is lockable in the second position, and the locking device prevents attachment of an electrical cord to the electrical socket.

10. The electrical socket as claimed in claim 9, wherein the projecting member is adapted to be rotated between the first and second positions.

11. The electrical socket as claimed in claim 9, wherein the projecting member is adapted to be slidable between the first and second positions.

12. The electrical socket as claimed in claim 10, wherein the projecting member is a T-shaped member, wherein in the first position the T-shaped member fits in the aperture, and in the second position the T-shaped member is rotated and cannot be withdrawn through the aperture.

13. The electrical socket as claimed in claim 9, including male connectors for insertion into apertures in the locking device.

14. The electrical socket as claimed in claim 9, wherein the electrical socket is a power receiver socket of an appliance.

15. The electrical socket as claimed in claim 9, wherein the electrical socket is a wall socket.

16. A locking device for female electrical socket, the female electrical socket including a plurality of openings and an aperture, comprising:

a device body for electrically isolating the female electrical socket, including:

a projecting member projecting from the device body for engagement with the aperture of the female electrical socket when the device body is inserted into the female electrical socket; and a plurality of male dummy connectors for insertion into the plurality of openings of the female electrical socket when the device body is inserted into the female electrical socket;

the projecting member having first and second positions, wherein:

in the first position the projecting member is movable within the aperture and the locking device can be connected and disconnected from the female electrical socket; and in the second position, the projecting member is locked within the aperture and the device body is locked within the female electrical socket, wherein, when the projecting member is locked within the female electrical socket, the device body prevents a power cord from being connected to the female electrical socket.

17. The locking device as claimed in claim 16, wherein the projecting member is provided adjacent the male dummy connectors on the device body.

18. The locking device as claimed in claim 16, wherein the projecting member is adapted to be rotated between the first and second positions.

19. The locking device as claimed in claim 16, wherein the projecting member is adapted to be slidable between the first and second positions.

20. The locking device as claimed in claim 16, wherein the aperture comprises an elongate aperture, and wherein the projecting member is a T-shaped member that corresponds to the elongate aperture provided in the female electrical socket, wherein in the first position the T-shaped member fits in the elongate aperture, and in the second position the T-shaped member is rotated and cannot be withdrawn through the elongate aperture.

* * * * *